United States Patent [19]

Steingroever et al.

[11] Patent Number: 4,794,358

[45] Date of Patent: Dec. 27, 1988

[54] MAGNETIC FIELD COIL WITH DISC-SHAPED CONDUCTOR

[76] Inventors: Dietrich Steingroever, 5060 Berg.-Gladbach 1; Erich Steingroever, Flensburger Str. 33, 5300 Bonn 1, both of Fed. Rep. of Germany

[21] Appl. No.: 899,402

[22] Filed: Aug. 22, 1986

[30] Foreign Application Priority Data

Mar. 29, 1986 [DE] Fed. Rep. of Germany ..... 3610690

[51] Int. Cl.[4] ..... H01F 5/00

[52] U.S. Cl. ..... 335/299; 336/232

[58] Field of Search ..... 335/284, 289, 299, 296; 336/225, 232, 227

[56] References Cited

U.S. PATENT DOCUMENTS

| | | | |
|---|---|---|---|
| 2,568,169 | 9/1951 | Raczynski | 336/225 X |
| 3,150,339 | 9/1964 | Wilska | 336/232 X |
| 3,227,930 | 1/1966 | Hnilicka | 335/299 X |
| 3,384,849 | 5/1968 | Brechna et al. | 335/299 |
| 4,595,899 | 6/1986 | Smith et al. | 335/299 |

*Primary Examiner*—George Harris
*Attorney, Agent, or Firm*—Harold Gell

[57] ABSTRACT

A magnetic field coil consists of discs made of an electrical conductor which have a radial slit, are spirally connected to one another, and by means of further radial slits, have an inner current-carrying region and an outer region which dissipates heat.

20 Claims, 2 Drawing Sheets

MAGNETIC FIELD COIL WITH DISC-SHAPED CONDUCTOR

The invention pertains to coils for the generation of strong magnetic fields, preferably those for pulse operation, which are supplied with current pulses from a capacitor discharge.

Coils of this kind which consist of disc-shaped conductors connected together in a spiral form (so-called "Bitter coils": F. Bitter, *Rev. Sci. Instr.* 7, 479, 482 (1936) are known. In these coils, a cooling fluid is conveyed through axial bores through the discs for cooling purposes. The outlay for this type of cooling is considerable. The purpose of the invention is to specify field coils with a simple and reliable cooling system using air, if at all possible.

The invention is characterized by the features of claim 1, according to which a magnetic field coil consists of disc-shaped electrical conductors which are spirally connected in series and for this purpose have a radial slit, and which have an inner annular region which conducts current and an outer region which dissipates heat.

The outer region, which dissipates heat and conducts no current or only a little current, results from the fact that the discs have further, essentially radial slits only in the outer region. Instead of this, the discs can also be thinner in their outer region than in their inner region, meaning that they become thinner towards the outside in steps or in a wedge shape.

The fact that the current is constricted into the inner region of the coil means that the ratio between field strength and current is improved, and at the same time, that sufficient cooling is possible.

Figure 1:
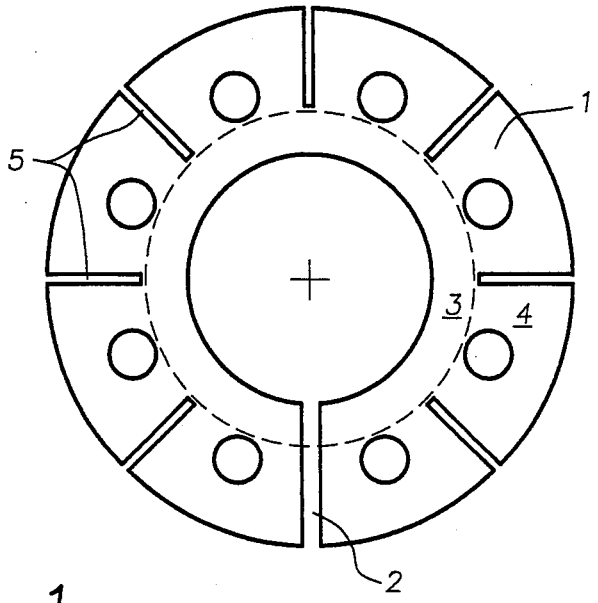

One example of the invention is illustrated in FIG. 1, in which:

1 indicates a round disc, e.g., made of copper, which has a radial slit 2 for spiral attachment to the next disc,

3 is the inner region which conducts current,

4 indicates the outer region which serves to dissipate heat. The two regions are separated by the dashed line.

5 are radial slits which prevent or weaken the flow of current in the outer region.

Figure 2:
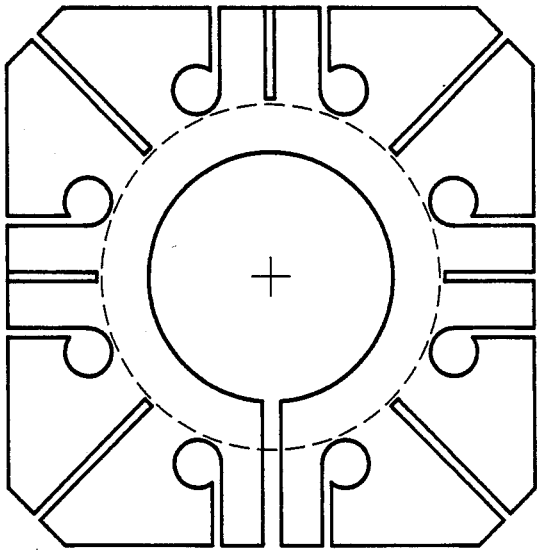
Figure 3:
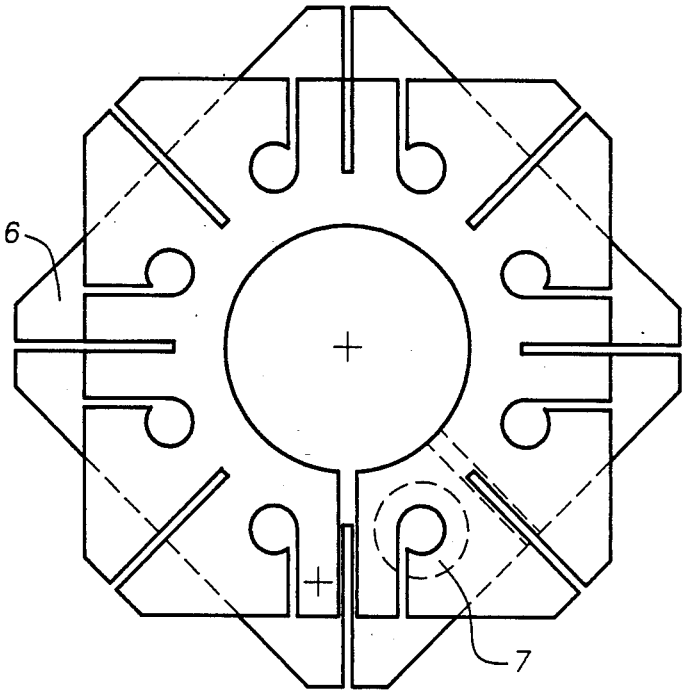

A particularly advantageous disc shape according to the invention is illustrated in FIG. 2. These discs are essentially square, so that their corners 6, when they are stacked with a 45° offset, project beyond the stack of discs (FIG. 3) and are easy to cool, e.g., with air or another cooling fluid. Current is supplied to the first disc at + and is conveyed at 7 through a copper ring to the next disc and so on to the last disc that is attached.

Figure 4:
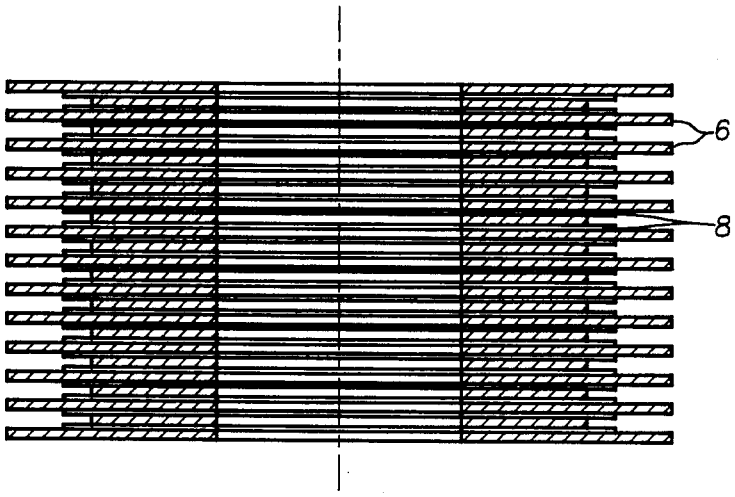

FIG. 4 illustrates a cross section of such a coil. The protruding corners 6 of the mutually offset discs form excellent cooling ribs. The individual discs are separated from one another by insulation discs 8 and are combined into a single package with the insulation discs by means of tie rods.

It is advantageous if the outer diameter or outer edge length of the discs is at least 1.5 times the inner diameter.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A magnetic field coil consisting of electrically conductive rectangular plates which have a radial slit and are spirally connected to one another in series, said plates including:

an inner annular region for conducting current;

an outer region for dissipating heat; and said plates are offset to each other around the central axis through their inner annular regions.

2. A magnetic field coil as defined in claim 1, wherein said plates include radial slits in their outer region.

3. A magnetic field coil as defined in claim 1, wherein said plates are thinner in their outer region in their inner region.

4. A magnetic field coil as defined in claim 1 wherein said plates include perforations in their outer region for tie rod means to hold said coil together.

5. A magnetic field coil as defined in claim 1 wherein said plates are square.

6. A magnetic field coil as defined in claim 1 wherein the outer edge length of said plates is at least $1.5\pi$ times the inner diameter of their inner annular region.

7. A magnetic field coil as defined in claim 1 wherein said plates are made of copper.

8. A magnetic field coil as defined in claimm 1 operated by the current pulses from a capacitor discharge.

9. A magnetic field coil as defined in claim 1 wherein said offset is 45°.

10. A magnetic field coil consisting of electrically conductive plates which have a radial slit and are spirally connected to one another in series, said plates including:

an inner annular region for conducting current;

an outer region for dissipating heat; and said plates are thinner in their outer region than in their inner region.

11. A magnetic field coil as defined in claim 10, wherein said plates include radial slits in their outer region.

12. A magnetic field coil as defined in claim 10 wherein said plates include perforations in their outer region for tie rod means to hold said coil together.

13. A magnetic field coil as defined in claim 10 wherein the outer edge length of said plates is at least $1.5\pi$ times the inner diameter of their inner annular region.

14. A magnetic field coil as defined in claim 10 wherein said plates are made of copper.

15. A magnetic field coil as defined in claim 10 operated by the current pulse from a capacitor discharge.

16. A magnetic field coil as defined in claim 10 wherein said plates are disc shaped.

17. A magnetic field coil as defined in claim 10 wherein said plates are rectangular and offset to each other around the central axis of said coil.

18. A magnetic field coil including electrically conductive plates, said plates comprising:

a planar shape including straight peripheral edges;

a central bore from which a radial slit emanates; and said plates are spirally connected to one another in series along the edges of said radial slits and offset to each other around an axis passing through their central bores.

19. A magnetic field coil as defined in claim 18, wherein said straight edges are joined to form at least two equal angles and said offset is at an angle which is one-half of said equal angle.

20. A magnetic field coil as defined in claim 19, wherein:

an inner annular current conducting region in each of said plates electrically connected in series to like regions of adjacent plates;

an outer heat dissipating region in each of said plates;

radial slits in said outer regions of said plates; perforation means in the outer regions of said plates for tie rod means for holding said coil together; the outer edge length of said plates is at least $1.5\pi$ times the diameter of their central bores;

said plates are metallic; and said plates are thinner in their outer region than in their inner region.

* * * * *